United States Patent [19]

Endo et al.

[11] Patent Number: 4,626,657

[45] Date of Patent: Dec. 2, 1986

[54] ELECTRIC HEATING APPLIANCE

[75] Inventors: Shinichi Endo; Isao Matsuda, both of Yamatokooriyama, Japan

[73] Assignee: Matsushita Electric Industrial Co., Ltd., Osaka, Japan

[21] Appl. No.: 694,560

[22] PCT Filed: Apr. 27, 1984

[86] PCT No.: PCT/JP84/00219

§ 371 Date: Jan. 3, 1985

§ 102(e) Date: Jan. 3, 1985

[87] PCT Pub. No.: WO84/04631

PCT Pub. Date: Nov. 22, 1984

[30] Foreign Application Priority Data

May 6, 1983 [JP] Japan ..... 58-79556

[51] Int. Cl.[4] ..... H05B 1/00; H05B 3/00

[52] U.S. Cl. ..... 219/212; 219/211; 219/517; 219/541; 200/61.04

[58] Field of Search ..... 219/211, 212, 517, 541; 338/273, 274; 200/61.04

[56] References Cited

U.S. PATENT DOCUMENTS

| | | | |
|---|---|---|---|
| 3,102,248 | 8/1963 | Temple | 338/274 |
| 3,708,649 | 1/1973 | Crowley et al. | 219/212 |
| 4,328,387 | 5/1982 | Kemble | 219/517 |
| 4,390,776 | 6/1983 | Yane et al. | 219/523 |

FOREIGN PATENT DOCUMENTS

| | | |
|---|---|---|
| 47-8408 | 2/1972 | Japan . |
| 48-47429 | 6/1973 | Japan . |
| 48-63117 | 10/1973 | Japan . |
| 51-113188 | 9/1976 | Japan . |

*Primary Examiner*—E. A. Goldberg
*Assistant Examiner*—M. M. Lateef
*Attorney, Agent, or Firm*—Birch, Stewart, Kolasch & Birch

[57] ABSTRACT

An electric heating appliance such as an electric blanket or the like which is so designed as to prevent damage, for example, extraordinary temperature rising resulting from the deterioration of components when the appliance is erroneously dry-cleaned. In accomplishing this object, the electric heating appliance is provided with a safety means which is dissoluble in a dry-cleaning solution to prevent the circulation of electricity to a heater (6). This safety means is constructed in the manner, for example, that a thin portion (10*a*) of a cord socket case shell (2) made of plastics dissoluble in a dry-cleaning solution is dissolved when dry-cleaned, and accordingly, a spring plate (3) is dashed out to prevent a plug (9) at the side of a controller (11) from being inserted into cord socket case (1) and (2), thereby obstructing the circulation of electricity to the heater (6).

3 Claims, 16 Drawing Figures

ELECTRIC HEATING APPLIANCE

TECHNICAL FIELD

The present invention relates to a washable electric heating appliance such as an electric blanket or an electric spread blanket.

BACKGROUND ART

Even among conventional electric heating appliances, for example, electric blankets, there are a few kinds of them which can be cleaned. However, even when, in order to provide a washable electric blanket, such textile fabrics with increased strength in the rate of shrinkage being small are employed and a cord socket case portion of the blanket for a cord plug is made water-proof, there often arises a problem of a dry cleaning to be applied to the fabrics.

More specifically, due to the bad influences of a dry cleaning solution on an electric blanket or the like which is comprised of a heater, temperature detecting lines, etc., each including plastic material, the heater after cleaning becomes thin as a whole, with its exterior surface being hardened. Therefore, the insulation thickness cannot be ensured thereby to bring about the chance of danger of insulation inferiority. Moreover, the temperature detecting lines are, after cleaning, deteriorated, with the impedance characteristics thereof rapidly changing and the temperature of the body of the electric blanket rising, thereby to cause the probability of danger such as burns or scalds.

DISCLOSURE OF INVENTION

Accordingly, an essential object of the present invention is to provide an improved electric heating appliance which is designed to prevent danger, through obstruction of the circulation or charging of electricity to a heater thereof, in the case that it is erroneously dry-cleaned.

In accomplishing the above-described object of the present invention, there is provided a safety means which is dissolved with a dry-cleaning solution for obstructing the circulation of electricity to the heater in the case of a dry-cleaning.

Hereinafter, the present invention will be described with reference to the accompanying drawings taken in conjunction with one preferred embodiment thereof.

BEST MODE(S) FOR CARRYING OUT THE INVENTION

Figure 1:
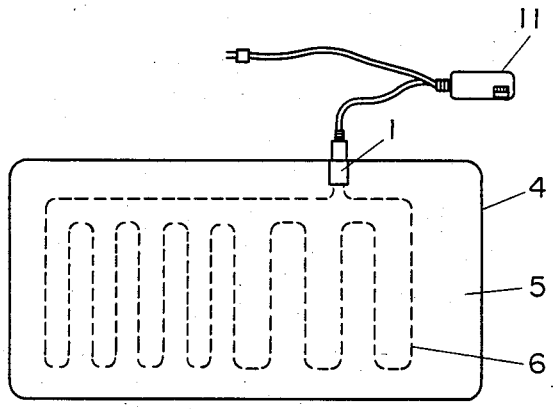
FIG. 1 is a top plan view of an electric heating appliance according to one preferred embodiment of the present invention.
Figure 2:
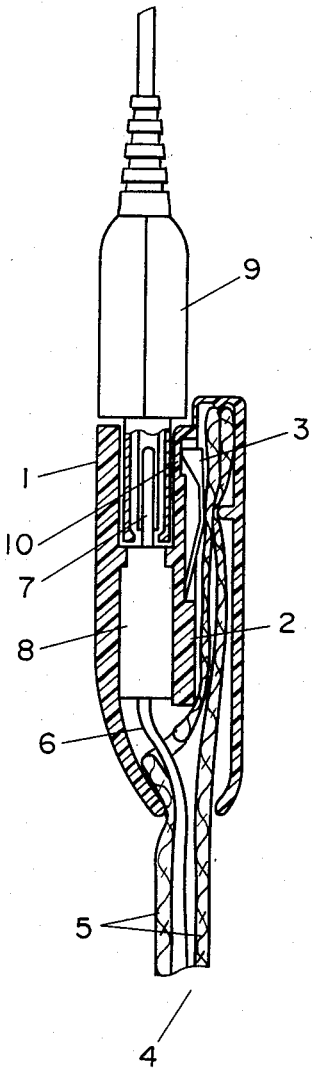
FIG. 2 is a cross sectional view of a cord socket cause for a cord plug of the appliance of FIG. 1.
Figure 9:
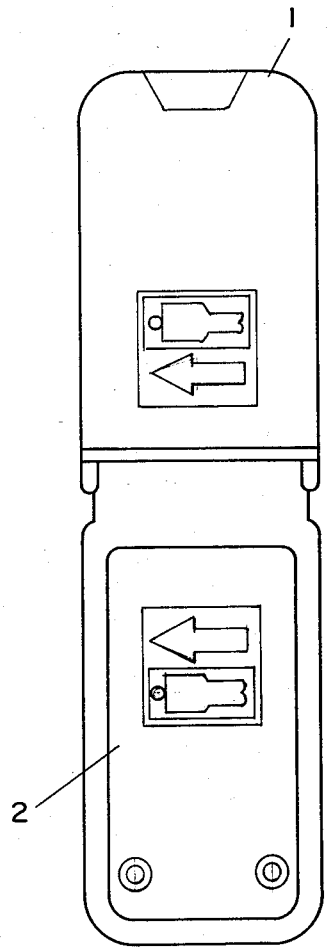
FIGS. 9 and 10 are, respectively, a developed top plan view and a developed front elevational view of the cord socket case.
Figure 10:
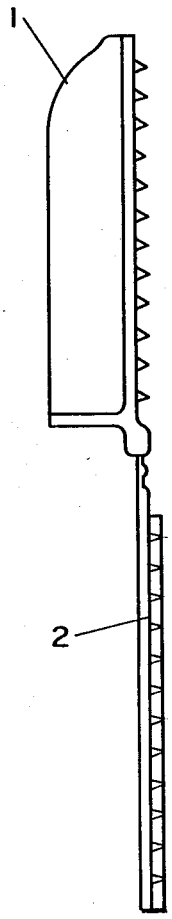

Referring to FIG. 1, a body 4 of an electric blanket of an elongated shape is comprised of a heater 6 wired within the textile fabrics 5 which are constituted into a bag-shape. In addition, an end portion of the heater 6 is connected to a terminal pin 7 within a cord socket case consisting of a pair of half shells 1 and 2 secured to each other as shown in FIG. 2. This connected area of the end portion is molded by a plastic mold 8. The cord socket shells 1 and 2 are constructed as shown in FIGS. 9 and 10. The shells are combined, with the textile fabrics 5 of the body of the electric blanket 4 sandwiched therebetween as shown in FIG. 2, and positioned as shown in FIG. 1.

Figure 11:
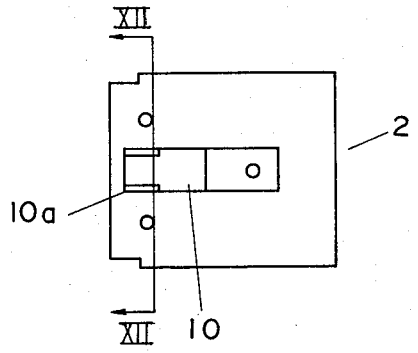
FIGS. 11 and 12 are, respectively, a bottom plan view and a cross sectional view of the cord socket case.
Figure 12:
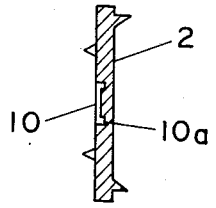
Figure 13:
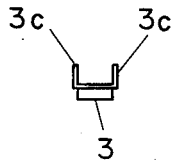
FIGS. 13 and 14, are, respectively, a side elevational view and a front elevational view of a spring plate of the appliance of FIG. 1.
Figure 14:
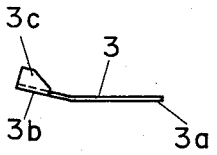
Figure 15:
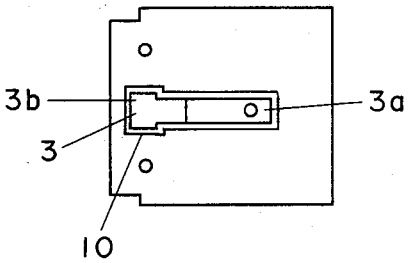
FIGS. 15 and 16 are, respectively, a bottom plan view and a front elevational view of the cord socket case below the spring plate.
Figure 16:
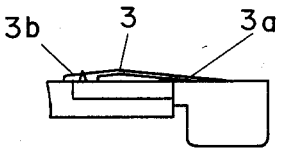

Next, the shell 2 has a spring plate 3 shown in FIGS. 13 and 14 includes therein for safety means in the practice of a dry-cleaning. In other words, on the reverse side of the shell 2 shown in FIGS. 11 and 12 is secured one end **3*a* of the spring plate 3 as shown in FIGS. 15 and 16, and the other end 3*b* of the spring plate 3 is pressed against a thin portion 10 of the shell 2. At this time, a claws 3*c* of the other end 3*b* is positioned in a thin groove 10*a* of the thin portion 10. It is to be noted here that the cord socket case 2 is made of a plastic that is dissoluble in a dry-cleaning solution, for example, petrolic plastics or styrene plastics. However, while a thin layer of plastic will be dissolved from the surface of the shell 2, for example, only the portion 10** will be completely dissolved because of its thinness.

Figure 3:
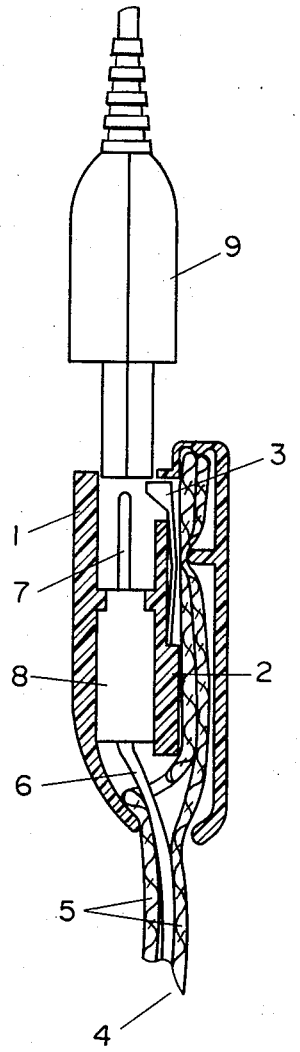
FIG. 3 is a cross sectional view showing the state where a safety means of the cord socket case for the cord plug operates.
Figure 4:
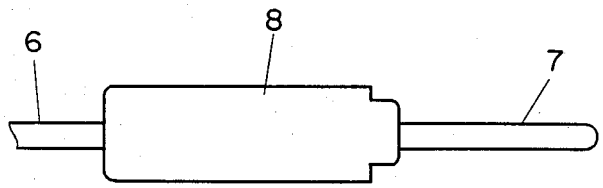
FIGS. 4–6 are, respectively, a front elevational view, a top plan view and a side elevational view showing the connecting portion between a heater and a terminal pin of the appliance of FIG. 1.
Figure 5:
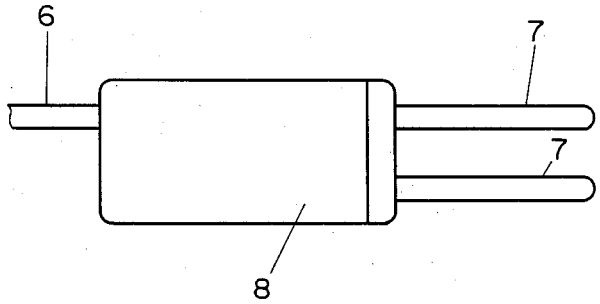
Figure 6:
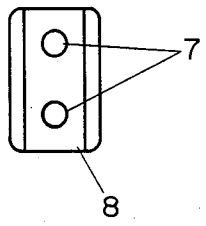
Figure 7:
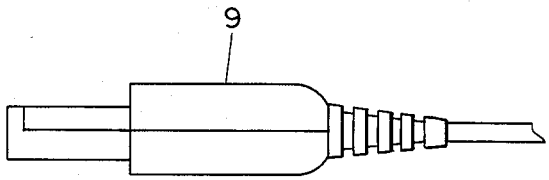
FIGS. 7 and 8 are, respectively, a front elevational view and a top plan view of a plug of the appliance of FIG. 1.
Figure 8:
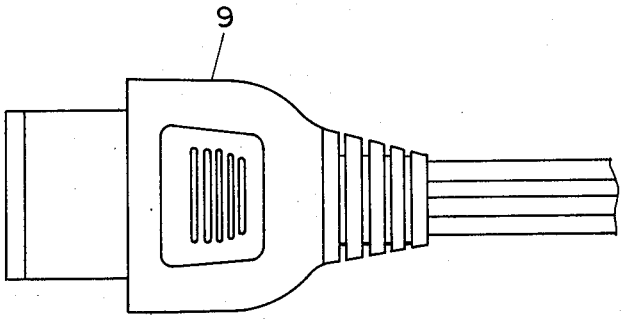

In the above structure, since the electric blanket has no trouble in the case of a normal water cleaning, a plug 9 at the side of a temperature adjusting controller 11, after cleaning, can be inserted into a predetermined position within the cord socket case 1 and 2 as shown in FIG. 2 to be connected with the terminal pin 7, thus starting the circulation of electricity to the heater 6 while the temperature is adjusted. On the contrary, referring to FIG. 3 which shows the case where the plug 9 is intended to be inserted into the cord socket case 1,2 of the erroneously dry-cleaned electric blanket, the thin portion 10, particularly, the portion located at the groove **10*a* is dissolved in the dry-cleaning solution, and the claw 3*a* of the spring plate 3 secured to the reverse face of the shell 2 is biased into the opening where the plug 9 is inserted. As a result of this, the plug 9 is prevented from being inserted into the cord socket case 1 and 2 by the claw 3*c*, and accordingly, the plug 9 is not connected with the heater 6, preventing the circulation of electricity to the heater 6**.

It is to be noted that the shell 2 is made of petrolic plastics or styrene plastics, and the thickness of the thin groove **10*a* of the thin portion 10 is set at 1 mm. It is also to be noted that the spring plate 3** is made of SUS304.

INDUSTRIAL APPLICABILITY

The electric heating appliance according to the present invention can display the following effects or advantages. In other words, when a prior art electric heating appliance is erroneously dry-cleaned even though it is prohibited, the components thereof are deteriorated and extraordinary heat is generated due to the change in temperature characteristics or the like. However, the electric heating appliance of the present invention is safe because it is so designed as to prevent the circulation of electricity to the heater in the above-described case, that is, an erroneous dry-cleaning case.

What is claimed is:

1. An electric heating appliance comprising a body, a heater provided in said body, and a safety means on said body which is dissoluble in a dry-cleaning solution for substantially preventing the circulation of electricity to said heater.

2. An electric heating appliance as claimed in claim 1, wherein said body is comprised of textile fabrics constituted in a bag-shape, a heater to be inserted into the textile fabrics, a cord socket case for fixing a terminal portion of said heater and a safety means which has a thin portion provided in said cord socket case and dissoluble in the dry-cleaning solution, and a spring plate pressing against said thin portion so that after said thin portion is dissolved a plug is prevented from being inserted into a predetermined position within the cord socket case.

3. An electric heating appliance as claimed in claim 2, wherein said thin portion is made of petrolic plastics or styrene plastics.

* * * * *